US007273139B2

(12) United States Patent
Lantz

(10) Patent No.: US 7,273,139 B2
(45) Date of Patent: Sep. 25, 2007

(54) COLLAPSIBLE, WHEELED SECURITY LUGGAGE

(75) Inventor: Paul D. Lantz, Kingston, PA (US)

(73) Assignee: A Rifken Co, Wilkes Barre, PA (US)

( * ) Notice: Subject to any disclaimer, the term of this patent is extended or adjusted under 35 U.S.C. 154(b) by 0 days.

(21) Appl. No.: 11/200,642

(22) Filed: Aug. 10, 2005

(65) Prior Publication Data

US 2006/0032719 A1 Feb. 16, 2006

Related U.S. Application Data

(60) Provisional application No. 60/600,280, filed on Aug. 10, 2004.

(51) Int. Cl.
*A45C 13/18* (2006.01)
*A45C 5/14* (2006.01)
*A45C 7/00* (2006.01)
*A45C 13/10* (2006.01)

(52) U.S. Cl. ..... 190/101; 190/18 A; 190/102; 190/107; 190/903; 292/307 R; 383/106

(58) Field of Classification Search ..... 190/101, 190/102, 122, 903, 18 A, 39, 107; 292/307 R; 383/106
See application file for complete search history.

(56) References Cited

U.S. PATENT DOCUMENTS 2,871,902 A * 2/1959 Weil ..... 206/38.1
3,141,536 A * 7/1964 Fulton ..... 190/119
3,971,458 A * 7/1976 Koenig ..... 190/120
4,494,592 A * 1/1985 Bonner ..... 383/5
4,512,599 A * 4/1985 De Lima Castro Netto ..... 292/307 R
4,995,656 A * 2/1991 Akashi ..... 292/307 R
5,452,930 A * 9/1995 Morgan ..... 292/307 A
5,749,446 A * 5/1998 Hsieh ..... 190/107
5,791,488 A * 8/1998 Lee ..... 206/768
6,292,438 B1 * 9/2001 Jones ..... 368/10
6,401,889 B1 * 6/2002 McCleskey ..... 190/102
6,431,334 B1 * 8/2002 Lin ..... 190/120
2002/0038744 A1 * 4/2002 Sukoff ..... 190/101
2002/0084159 A1 7/2002 Hamlin
2002/0125089 A1 9/2002 Davis et al.
2002/0125090 A1 * 9/2002 Mercado et al. ..... 190/107
2003/0201893 A1 10/2003 Redburn et al.
2004/0149600 A1 * 8/2004 Wolter et al. ..... 206/223
2004/0206431 A1 10/2004 Metzig et al.

FOREIGN PATENT DOCUMENTS

FR 2563093 A1 * 10/1985
GB 2246759 A * 2/1992
JP 2002253324 A * 9/2002
WO WO 02/13650 A1 2/2002

OTHER PUBLICATIONS

EPO, PCT/ISA 210, 220, and 237 for PCT/US2005/028384 (filed Aug. 10, 2005), mailed Dec. 9, 2005.

* cited by examiner

*Primary Examiner*—Sue A. Weaver
(74) *Attorney, Agent, or Firm*—Bradley N. Ruben

(57) ABSTRACT

Luggage that is easy to transport and easy to store is provided with security tags to enable the passenger and terminal security officers to determine the last person to seal the luggage, enabling a passenger to determine if the luggage was searched, and enabling security personal to determine whether the luggage was previously searched.

8 Claims, 7 Drawing Sheets

101
103
105a
105b
107
108
109
111
113
115
117
119
12
125
127
129
201
203
205
207
209

COLLAPSIBLE, WHEELED SECURITY LUGGAGE

PRIOR APPLICATIONS

This application is based on U.S. provisional application No. 60/600,280, filed 10 Aug. 2004, the disclosure of which is incorporated herein by reference.

BACKGROUND OF THE INVENTION

This invention relates to luggage having wheels for easier transport, a collapsible frame for easier storage, and a security and/or tamper evident lock.

Generally, wheeled luggage is constructed with a frame and wall system enclosed by a body of a flexible material, usually a fabric. The frame usually has top and bottom pans—so-named for their "pan shape" with a base and edge flanges—that are molded from a rigid durable plastic and are coextensive with the top and bottom walls. Parallel tubes that receive the legs of a U-shaped towing bar join the top and bottom pans. The bottom pan supports wheels. Side stiffener panels, which are coextensive with the sides of the body, and a back panel are joined to the flange portions of the top and bottom pans.

Like most "old-fashioned" hand-carried luggage, modern wheeled luggage of the type described above is strong and durable and serves its purpose very well. It has the additional advantage of being easy to move by towing it on its wheels. Full-framed luggage, either with or without wheels, has the disadvantages of being relatively heavy, in large part because of the frame and stiffener panel system, and of occupying a large amount of space when stored.

Wheeled articles of luggage, such as carrying cases, have become quite popular, especially for use while traveling. The most popular type of wheeled carrying luggage includes wheels on a lower side and a retractable handle. The handle is extended and is used for towing of the case with the wheels engaged against the ground. Placing the weight of the luggage on the wheels permits a traveler to roll the luggage from one location to another, instead of having to carry the luggage, relieving the burden typically placed on the shoulders, back, and arms of the traveler.

As noted above, wheeled carrying bags are made of rigid sidewalls and a heavy reinforcing bottom panel. The rigid construction of the sidewalls holds open the walls of the luggage, permitting easy packing of the inside compartments of the luggage. The rigid bottom panel and sidewalls stabilize the luggage during towing. In addition, the bottom panel often provides an attachment location and support for the wheels.

While the prior art wheeled carrying bags work for their intended purpose, the rigid nature of the bags makes their storage difficult, because the hard-sided bags require as much storage space when they are empty as they do when they are full.

Various designs have been created to provide for wheeled and/or collapsible storage bags, such as described in the following U.S. patents and patent applications (the disclosures of which are incorporated herein by reference in their entirety): U.S. Pat. No. 6,401,890; U.S. Pat. No. 6,443,274; U.S. Pat. No. 6,604,617; 2003/0034636; 2003/0085552; and 2003/0213667. One could use a disposable envelope such as described in GB 2 386 061 A, but that adds additional material. One could use a "Baggage Guard Seal" (On the Go Publishing, Columbus, Ohio) which is akin to seals used on water meters and the like, but once opened by a security agent for searching, would not be replaced. Similar to disposable locks, once opened by a security agent for search, it will not be replaced. Alternatively, the traveler's bag can be sealed using RFID (*IEEE Aerosp Electron Syst Mag*, Vol. 18, No. 3, March 2003, pp. 13-15), and tracked through to the destination, but there is no provision for resealing by the typical traveler.

Present security measures exercised at departure points (typically airports) in the United States, administered by the Transportation Security Authority (TSA), requires that individuals submit their person and accessible property to screening and searching. In addition, each airport operator must establish a secure area and have a security program. The security measures, as are well-known to travelers, include screening and possible searching of carry-on luggage, as well as screening and possible searching of checked luggage. To allow passengers to maintain secured luggage, but allow airport and/or TSA security agents to search luggage, various manufacturers have developed locks that are "approved and recognized" by TSA (http://www.tsa.gov/public/interapp/editorial/editorial_1634.xml). That TSA website also notes TSA has the ability to open some locks that are not listed, but time pressures may require screeners to cut locks because there are multiple master keys for multitude of locks that can be opened by, and/or are "approved and recognized," by TSA.

SUMMARY AND OBJECTS OF THE INVENTION

In light of the foregoing, what is still needed to facilitate travel is luggage having a lock that is easy to open, that will facilitate security screening measures, that will provide evidence to the owner whether their luggage was searched, that can be viewed by security agents to determine the most recent individual or organization to access the luggage, and that can be wheeled for easy transport and collapsed for easy storage.

Towards this end, the present invention provides a wheeled, collapsible luggage device having a tamper-evident security seal that can be easily removed to access the luggage, and at least one other seal to replace a seal removed for security screening of the luggage, each seal having indicia thereon identifying the last entity to seal the luggage.

In essence, luggage is provided that is easy to transport, namely wheeled, and easy to store, namely collapsible, and is also provided with security tags to enable the passenger and terminal security officers to determine the last person to seal the luggage, enabling a passenger to determine if the luggage was searched, and enabling security personal to determine whether the luggage was previously searched.

DETAILED DESCRIPTION OF SPECIFIC EMBODIMENTS

Figures 1, 2, 3A, 3B:
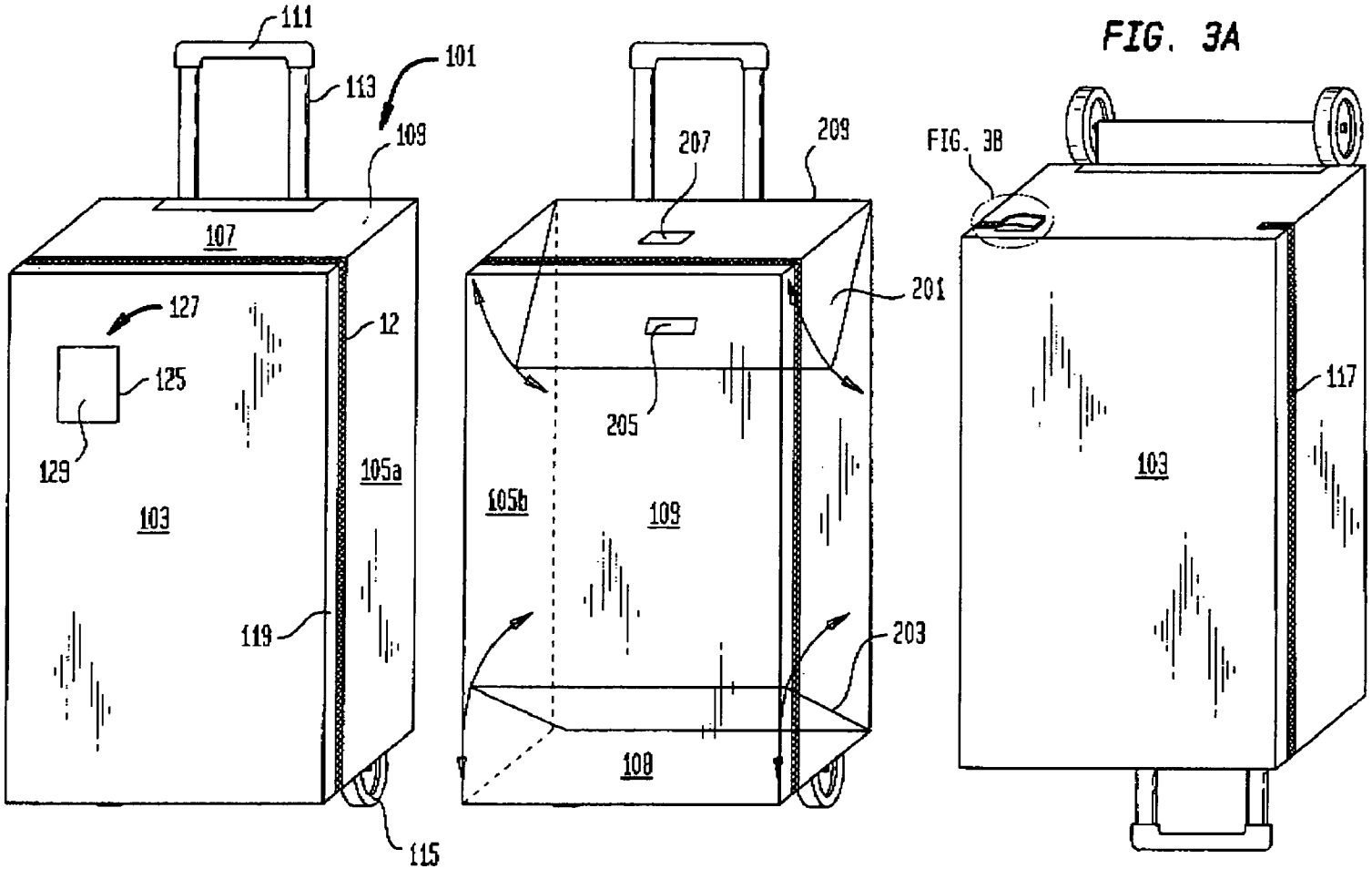
FIG. 1 depicts a front perspective view of the luggage.
FIG. 2 is a view showing the inside of the luggage through the outer walls.
FIG. 3A is an upside down front perspective view.
FIG. 3B is a close-up of the security chamber.
Figure 3B:
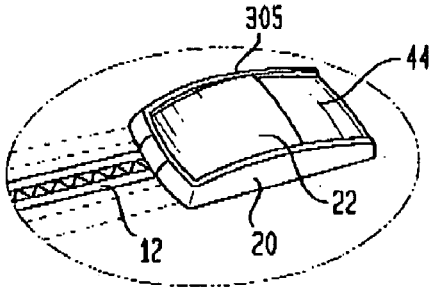

As shown in FIGS. 1 and 2, the luggage 101 includes a front wall 103, opposing side walls 105*a/b*, a top wall 107, a bottom wall 108, and a rear wall 109, such that all of the walls cooperate to define an interior luggage space. The article includes a handle 111 posited on extendable supports 113 held in a frame (not shown) well-known in the art. The supports slide into the frame to provide a low profile for the handle, and are slid out from the frame to extend the handle as shown in FIGS. 1 and 2. The luggage is supported and moved by virtue of wheels 115 disposed on the bottom, although as is known in the art the wheels could be positioned on one of the side panels. The wheels are supported typically by a frame unitary with the frame into which the handle supports slide. A zipper 12 preferably extends from a first side 117 around the perimeter of the front wall and passing through the side, top, and bottom walls, each leaving a small flange 119 attached to the front wall. As is appreciated in the art, the zipper could instead define a flap in the front wall.

The walls of the luggage device are preferably made of a durable fabric, such as nylon, although any flexible material that allows the device to be collapsed is suitable. Accordingly, the walls could be made of cotton or polyester fabric, or leather. Also, different walls can be made of different materials; such as the sides, top, and bottom being made of leather, while the front and back are made of nylon.

As seen specifically in FIG. 2, it is preferred to provide the collapsible aspect by including at least two panels 201 and 203 that lie, respectively, against the top and bottom walls. Additional panels can be provided to lie against each of the side walls, as well. The panel is preferably made of a size that is approximately equal to the area of the wall against which it lies. To facilitate the panel maintaining an orientation flush with the adjacent wall, cooperating releasable mechanical attachment devices 205 and 207, such as those sold as VELCRO brand fasteners (or snaps, or the like), one attached to the wall and one attached to the panel, can be used. Preferably, each panel comprises a hard plastic core within a fabric (e.g., nylon) sleeve. The advantage to such a construction is that fabric luggage is typically made by sewing the walls to each other, so the sleeve in which the core of the panel is housed can easily be sewn to the structure along a seam, such as seam 209. Thus, the panel is permanently attached to the luggage, pivotable about the seam, can be secured to the inside of the wall using a releaseable mechanical fastener, and can be released and folded back to allow the luggage to be collapsed. The arrows indicate the respective movement of the panels.

Figure 5:
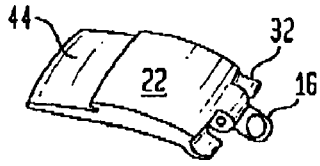
FIG. 5 is a top perspective view of the chamber and slide.
Figure 6:
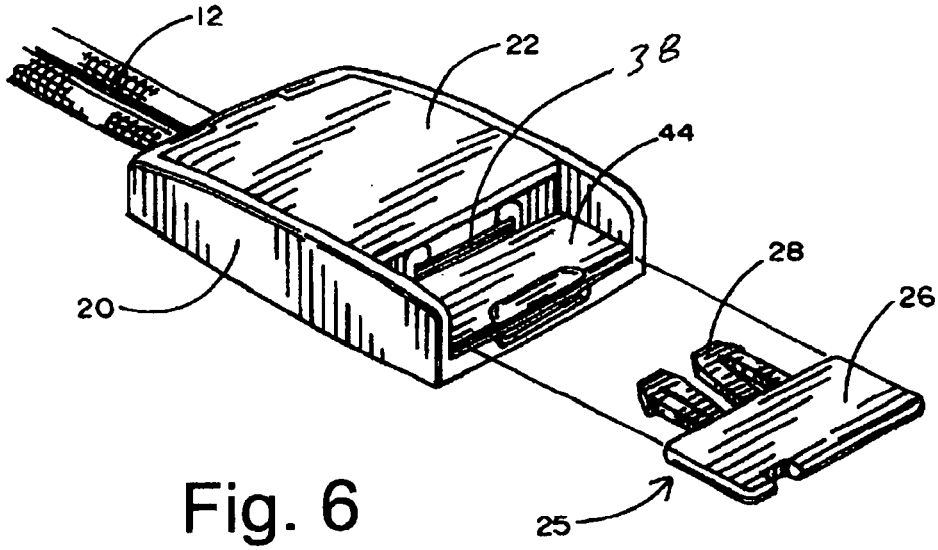
FIGS. 6-11 are top perspective and side views showing how the security chamber is used.
Figure 7:
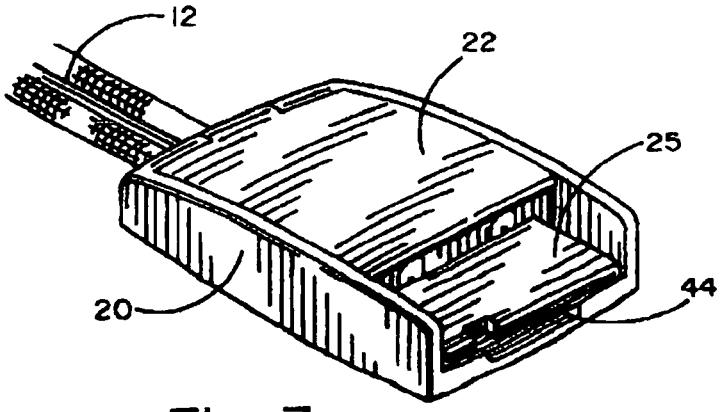
Figure 8:
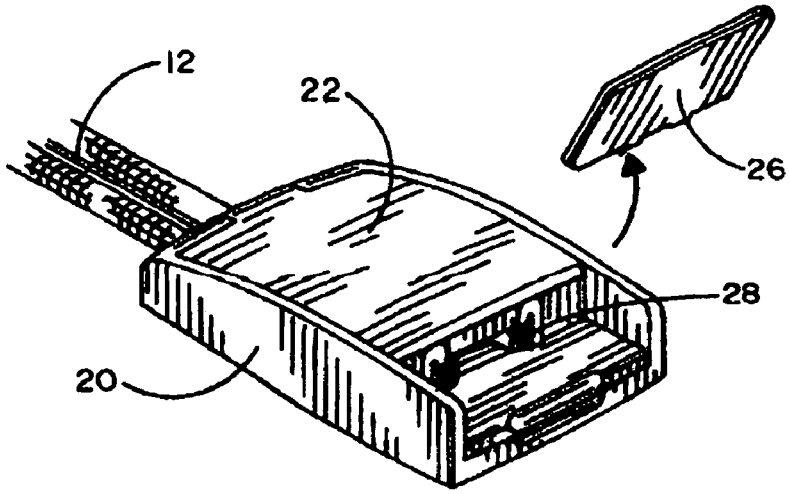
Figure 9:
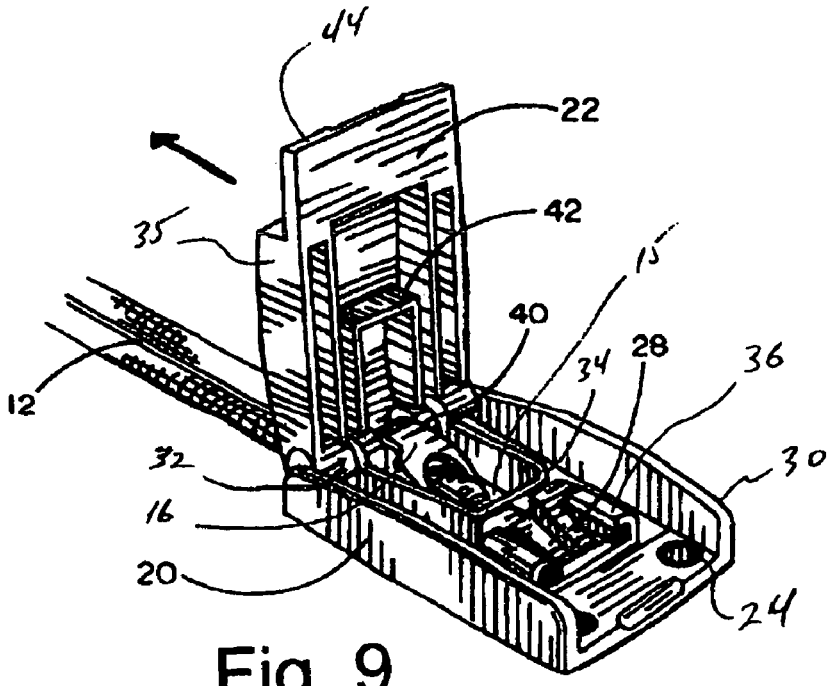
Figure 10:
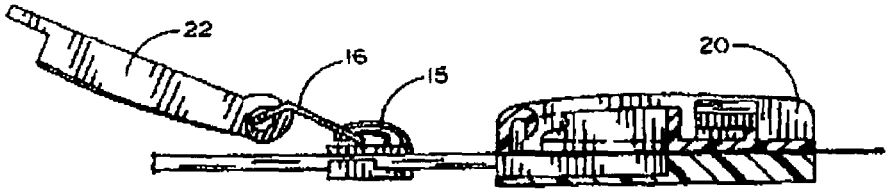
Figure 11:
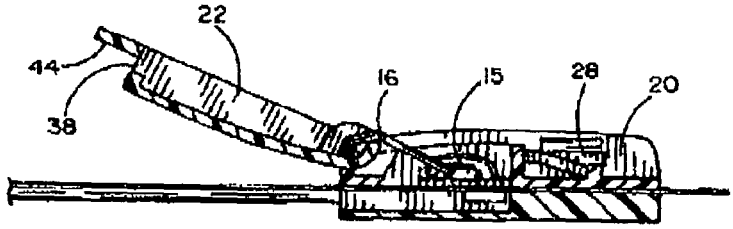

FIG. 3A shows the bottom front perspective where the locking chamber 301 is disposed when the luggage is secured. Such a chamber is preferably of the type shown and described in U.S. Pat. No. 6,533,335 (the disclosure of which is incorporated herein by reference). Referring to FIGS. 6-11, it will be seen that a preferred embodiment of the security device operates as a seal enclosure connected to a zipper 12. The zipper slider 15 is connected to a puller 16 which is connected to closure member 22 which constitutes the moveable part. The fixed part of the seal enclosure comprises a housing 20 which is permanently affixed to the luggage by a plurality of rivets 24 or equivalent fasteners extending through the wall. The closure member is locked to the housing 20 by a frangible seal 25 which comprises a handle portion 26 and a pair of spine-loaded barbed hooks 28, although any catch-type device is suitable. Housing 20 comprises a frame 30 having a pair of spaced apart pivot members 32 and an outer slider barrier 34, immediately adjacent which is a seal receptacle 36 configured to receive the hooks 28 of seal 25. Closure member 22 comprises a frame 35 having a closure flange 44 extending therefrom and an aperture 38 at the junction of the frame and the flange. Frame 35 terminates in a pair of arched claws 40 and also comprises an inner slider barrier 42. In operation, the closure member 22 is separated from housing 20 because zipper slider 15 is spaced from the housing. The slider is fully rotated into barrier 34 and claws 40 have engaged pivot members 32 for rotation around the pivot members. Closure member 22 has been rotated into a fully closed position in FIG. 6 until flange 44 is in contact with housing 20. Inner barrier 42 nests within outer barrier 34. As shown in FIGS. 6 and 7, seal 25 and specifically hooks 28, are then inserted through aperture 38 and through seal receptacle 36 until handle 26 rests on closure flange 44. To then open the chamber, handle 26 must be broken and separated from hooks 28 as shown in FIG. 8. The closure member can then be rotated to allow the claws to be lifted out of engagement with the pivot members to allow the slider to be removed from the barrier. A principal feature of the present closure chamber is the degree to which the enclosure renders the seal externally inaccessible, denying all attempts to open the zipper without breaking the seal. FIG. 3B shows a top perspective of the closure chamber, and FIG. 5 provides a top perspective of the top portion thereof.

Although shown with two prongs in FIG. 6, it is sufficient if the seal has or accepts a catch, such as a pawl, but unlike a pawl designed to be disengaged only by at least compromising the integrity of the seal (that is, compromising the structural integrity of the seal). Various other pawl type catches are well-known in the art (and some are commercially available from A. Rifkin Co., Wilkes-Barre, Pa.). For example, catches may extend from a central stem rather than separate stems, or instead of the hook-like part of the catch facing outwardly as shown, it may face inwardly towards the other catch. It may also be possible to design an interference fit such that the seal cannot be removed except by being at least partially destroyed. In general, any means using a device which can be inserted into place preventing full access, and which must be removed by at least compromising the device, is suitable as the seal of this invention. "Compromising" the seal includes such operations as breaking and bending; thus, the seal may have been compromised by being bent or broken, even though the closure may remain closed. Thus, the seal of this invention performs both an indicating function and a sealing function. Plastics can be engineered to have sufficient strength and insufficient elasticity (e.g., sufficiently brittle) that when used as a seal the seal must be broken to be removed, whereby access is evident. Other plastics and metals will have a change in their structure when bent, forming a crease or seam line, thereby evidencing their having been compromised. Accordingly, "compromise" can be defined as an insult to the integrity of the seal structure, even if such compromise does not affect its function as a seal. When the seal remains in place but the compromise is present and can be determined, tampering is evident. Accordingly, it should be appreciated that the same degree of compromise may not be required to evidence tampering as that required to allow the closure to be opened.

Figure 4:
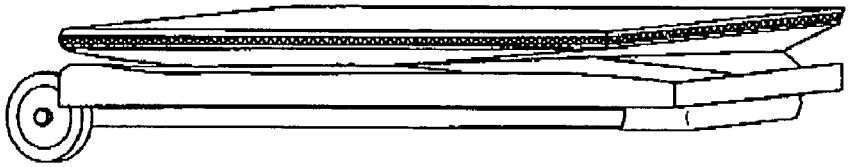
FIG. 4 is a side view of the luggage collapsed.

FIG. 4 depicts a side perspective view of the luggage article wherein the panels are rotated to be flush with the back wall.

Figure 13:
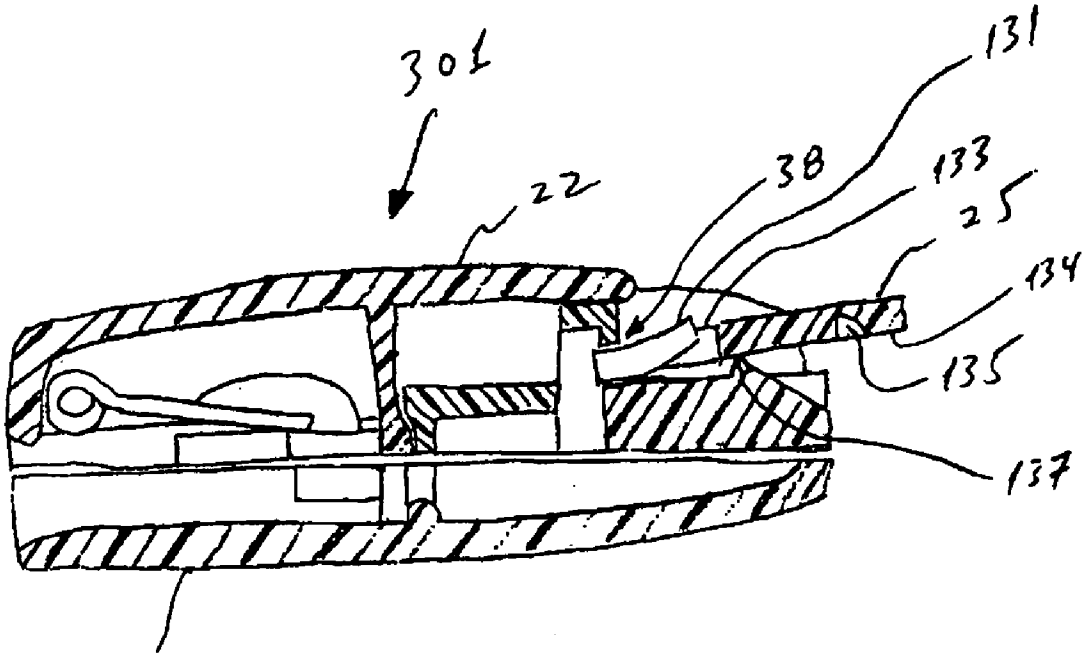
FIG. 13 is a cross section of another embodiment of the sealing chamber and seal.

FIG. 13 depicts a cross section of two different embodiments of a seal and chamber for use with each other. As seen in the closure and seal 301 depicted in FIG. 13, in this embodiment the seal prongs (analogous to 28 in FIG. 6) are curved 131 to lie above the top surface 133 of the seal, so that the prongs engage the back side of the opening both through transverse spring action that squeezes the prongs so they fit through the opening, as well as spring action orthogonal thereto, by forcing the curved barbs or prongs to lie flat as they pass though the opening. In yet another embodiment, the bottom surface 134 of the seal has a groove 135 that engages a corresponding ridge 137 disposed on the flange 44. In this embodiment, the tolerances are designed such that the ridge engages the groove as the prongs are just seated. Although shown together in the same seal, these separate embodiments may be present singly in a given device. An advantage of these seal embodiments is that with properly designed tolerances, the engagement of the curved prongs with the back of the opening, and/or engagement of the groove with the ridge, produces a distinct "click" sound so that the user knows that the seal is engaged.

As noted above, it is often the situation that a traveler must check luggage, which is then searched before being loaded onto the vessel of travel. Unless the traveler's lock on the luggage is TSA approved, it is best not to lock the luggage else the existing (non-approved) lock might be destroyed in a search of the luggage, thereby possibly compromising the integrity of the luggage. Further, even with a TSA approved lock, there is no indication whether a given article of luggage has been searched.

Figure 12A:
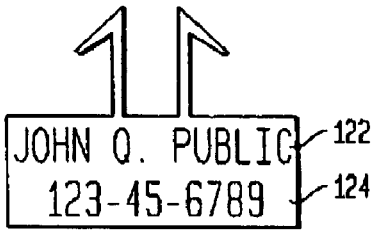
FIGS. 12A and 12B are top views of the seal with different embodiments of the indicia printed thereon.
Figure 12B:
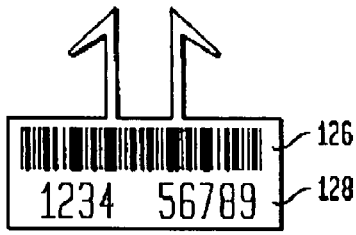

As shown in FIGS. 12A and 12B, the seal can have indicia printed thereon identifying the owner. As shown in FIG. 12A, such indicia might include the person's name 122 and Social Security number 124. Instead of the Social Security number the person's driver's license number, address, or some other printed information, as desired. Alternatively, the traveler could use a seal of a single color without any printing, or could use a seal with multiple colors, with or without printing. The seal is preferably made from plastic. When the traveler checks the luggage, the carrier might search the luggage as part of the security measures at that point of transit. To search the luggage, the carrier must break off the existing seal, search the luggage, and can then replace the seal with another seal. Such a replacement seal is shown in FIG. 12B, wherein the seal includes a printed bar code 126 and a numerical identification 128. The use of a bar code enables hand-held or wrist-worn readers to log the code for tracking through the security area to the destination. Obviously, any indication on the replacement seal indicating that the carrier had conducted a search of the luggage is sufficient. Thereafter, or instead, the TSA, or a similar organization in another country (of travel or through or originating in another country) would use its own seal after breaking the existing seal, search the luggage, and then reseal the luggage. The replacement seals can also have an indication of the person or sub-organization conducting the search.

Such a system, using different seals to identify the last entity (person, organization, or part thereof) to search the luggage, provides increased security because it can be immediately determined whether or not an article of luggage was search, and who searched the luggage. In addition, when the luggage is checked, the carrier can substitute a seal with one sort of indicia indicating that the luggage has been checked but not yet searched, and another seal with different indicia indicating that the luggage has been searched. Also, the traveler, upon claiming the luggage upon arrival, can determine the last entity to have searched the luggage if any items are missing. By this system, it can clearly be seen whether the luggage was searched and the last entity sealing the luggage. The preferred chamber shown in FIGS. 6-11 includes the frame 30 which protects the seal from unintentional breakage by virtue of the upstanding side walls. In addition, security personnel do not have to fumble with dozens of master keys to find the correct one for opening a given lock, and there are still published reports of approved locks being cut off by security personnel (likely because they have only a limited amount of time to search through a piece of luggage and do not want to waste time searching for the proper master key). While the preferred chamber shown is attached to the zipper, a similar chamber not permanently attached to the back can be used or purchased by the consumer, or even provided at check-in. Thus, a simple relatively permanent plastic band or line, such as a plastic cinch or cinch buckle, can be provided with the replaceable ID tag as shown. Alternatively, a cinch in which two ends of a band or line are held can be used with the ID tag: the line is secured through the bags closure effective to prevent access, the ends secured in the cinch, and the tag inserted; for searching, the line can be cut, the baggage searched, and then replaced with a new line using the same cinch and a new seal.

To facilitate more complete tracking, the luggage can be provided with a pocket 125 (FIG. 1) on the outside of the luggage to hold broken seals; the pocket has an opening 127 (that may also have a closure, such as a flap, which can be releasably mechanically secured) and preferably a transparent or translucent outer pocket wall 129 to enable one to see if the discarded seals are present in the pocket. Thus, when the traveler's seal is broken off for a search by the carrier, the traveler's broken seal is deposited in the pocket, and then the luggage is sealed with the carrier's seal after the search is conducted. If thereafter, for example, a TSA security agent desires to search the same luggage, the carriers seal is broken off and deposited in the pocket, and a TSA seal is used to re-secure the luggage after search. The TSA, if finding a prohibited article in the luggage, knows that the luggage was searched by the carrier and thus either the carrier's agent missed the article or placed the article in the luggage. The traveler, upon claiming the luggage, if anything is missing, or has been added, has two broken seals (from the carrier and TSA security agents) and can show that the bag was searched. The use of a bar code or unique personal identifier by the carrier and/or TSA (or any security agent) can be used to identify the particular agent searching any given piece of luggage.

Figure 14:
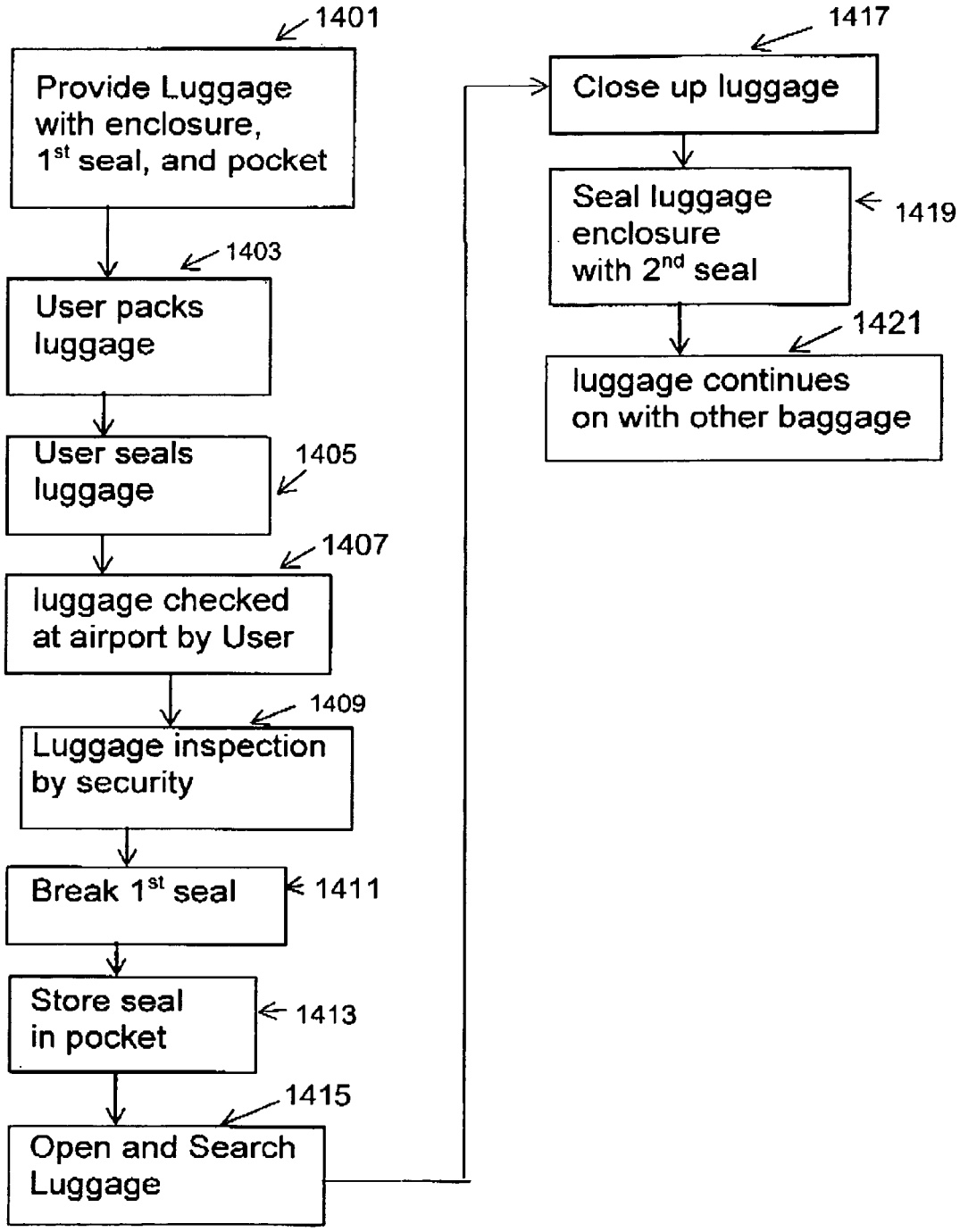
FIG. 14 is a flow chart depicting a method of using the luggage and seals in a securement system.

FIG. 14 depicts a flow chart showing the method of using the luggage. As depicted, luggage having the enclosure, a first seal, and the transparent or translucent pocket on the outside is provided 1401 to the user; typically this is by the user traveler purchasing the luggage. The user packs the luggage 1403, and then seals the luggage 1405 using the first seal. The luggage is checked at the airport 1407 or other terminal of departure (e.g., port or berth, train station) and sent with other luggage In the case where a security search of the luggage 1409 is conducted by security personnel, the first seal is broken 1411 and the broken seal is then stored in the pocket 1413 disposed on the outer surface of the luggage. The security personnel then opens and searches the luggage 1416. Once the search is finished, and assuming the luggage is safe to pass on, the security officer closes the luggage 1417 and seals the luggage with a second seal 1419, preferably one having information identifying the searcher (such as identifying the security agent, the organization, etc.) The luggage then continues on with other baggage. A search may be conducted at the final or an intermediate designation, in which case the second security seal that is broken to conduct this later search is likewise stored in the pocket and a third seal is used to secure the luggage.

The instant invention also provides the advantage of being able to secure the luggage in a hotel room or when left at a concierge or the left luggage counter at an airport. The traveler need only insert a seal prior to leaving the room (especially if the room does not have a safe, or the article is too large to fit into the safe) or leaving the luggage.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A luggage securement system comprising:

A. luggage having opposing front and rear walls, opposing side walls, and opposing top and bottom walls, attached at adjacent wall edges, all cooperating to define an interior luggage space, said walls being of a flexible material able to be collapsed;

B. at least one pair of panels rotatably attached at adjacent edges effective to be disposed adjacent to and parallel to opposing walls;

C. a zipper disposed around the perimeter of one of the walls and defining an opening;

D. a seal enclosure for use with a tamper evident frangible seal for the zippered opening, the enclosure comprising a housing permanently affixed to said wall adjacent said zippered opening, a closure member pivotally and releasably attached to said housing and forming a selectively closed barrier around said seal to prevent access to said seal without first breaking said seal; and E. at least two tamper evident frangible seals, a first seal having indicia representative of the traveler owning the luggage and a second seal having indicia representative of a security entity having authority to search said luggage.

2. The system of claim 1, wherein the luggage further comprises a transparent or translucent seal pocket disposed on said exterior luggage surface, having an opening accessible from the exterior luggage surface, and adapted to retain and allow viewing of a plurality of broken seals.

3. The luggage securement system of claim 1, further comprising a retractable handle and wheels each attached to said luggage.

4. The luggage of claim 1, wherein each panel and the wall to which it is adjacent has means for releasably and mechanically securing the panel to said adjacent wall.

5. A method for securing luggage and indicating that said luggage has been searched, comprising:

providing

A. luggage having opposing front and rear walls, opposing side walls, and opposing top and bottom walls, attached at adjacent wall edges, all cooperating to define an interior luggage space, said walls being of a flexible material able to be collapsed;

B. at least one pair of panels rotatably attached at adjacent edges effective to be disposed adjacent to and parallel to opposing walls;

C. a zipper disposed around the perimeter of one of the walls and defining an opening;

D. a seal enclosure for use with a tamper evident frangible seal for the zippered opening, the enclosure comprising a housing permanently affixed to said wall adjacent said zippered opening, a closure member pivotally and releasably attached to said housing and forming a selectively closed barrier around said seal to prevent access to said seal without first breaking said seal; and E. at least two tamper evident frangible seals, a first seal having indicia representative of the traveler owning the luggage and a second seal having indicia representative of a security entity having authority to search said luggage;

a traveler securing the luggage with the first seal; and a security agent breaking the first seal, searching the luggage, and resealing the luggage with said second seal.

6. The method of claim 5, wherein the luggage further comprises a transparent or translucent seal pocket disposed on said exterior luggage surface, having an opening accessible from the exterior luggage surface, and adapted to retain and allow viewing of the seal broken by the security agent, and wherein the method further comprises storing the broken seal in said pocket.

7. The method of claim 5, wherein the luggage further comprising a retractable handle and wheels each attached to said luggage.

8. The method of claim 5, wherein each panel of the luggage and the wall to which it is adjacent has means for releasably and mechanically securing the panel to said adjacent wall.

* * * * *